US010309055B2

(12) United States Patent
Conard

(10) Patent No.: US 10,309,055 B2
(45) Date of Patent: Jun. 4, 2019

(54) METHOD AND APPARATUS FOR CREATING AN IMAGE ON FABRIC

(71) Applicant: Adam Michael Conard, Denver, CO (US)

(72) Inventor: Adam Michael Conard, Denver, CO (US)

( * ) Notice: Subject to any disclaimer, the term of this patent is extended or adjusted under 35 U.S.C. 154(b) by 63 days.

(21) Appl. No.: 13/972,458

(22) Filed: Aug. 21, 2013

(65) Prior Publication Data

US 2017/0167077 A1 Jun. 15, 2017

(51) Int. Cl.

| | |
|---|---|
| ***D06P 5/00*** | (2006.01) |
| ***D06P 7/00*** | (2006.01) |
| ***D06P 1/00*** | (2006.01) |
| ***A41D 27/08*** | (2006.01) |
| ***D06P 5/28*** | (2006.01) |

(52) U.S. Cl.

CPC ..... *D06P 5/004* (2013.01); *D06P 1/004* (2013.01); *D06P 1/0012* (2013.01); *D06P 1/0096* (2013.01); *D06P 7/005* (2013.01); *A41D 27/08* (2013.01); *A41D 2500/10* (2013.01)

(58) Field of Classification Search

CPC ..... D06P 5/004; D06P 7/005; D06P 1/0012; D06P 1/004; D06P 1/0096; A41D 27/08; A41D 2500/10

See application file for complete search history.

(56) References Cited

U.S. PATENT DOCUMENTS 3,498,874 A * 3/1970 Shambelan ..... D04H 18/04 162/115

* cited by examiner

*Primary Examiner* — Amina S Khan

(74) *Attorney, Agent, or Firm* — Eldredge Law Firm, LLC; Richard Eldredge; Beth Felix

(57) ABSTRACT

Exciting and flashy images are created on a garment with a method that includes the steps of selecting a stretch fabric having a front side and a back side. A front side of the fabric is dyed with a solid color. A back side of the fabric is dyed with a knock out image. The knock out image is visible when the stretch fabric is stretched and is not visible when the stretch fabric is in a relaxed state. In one case, the fabric is part of jersey and when the player stretches the fabric an image becomes visible. In another case, the image expands or seems to glow. This provides a dynamic flashy image that is exciting to advertisers and fans alike.

10 Claims, 4 Drawing Sheets

METHOD AND APPARATUS FOR CREATING AN IMAGE ON FABRIC

RELATED APPLICATIONS

The present invention claims priority on provisional patent application, Ser. No. 61/736,433, filed on Dec. 12, 2012, entitled "StretchGLOW Technology" and is hereby incorporated by reference

STATEMENT REGARDING FEDERALLY SPONSORED RESEARCH

Not Applicable

THE NAMES OF THE PARTIES TO A JOINT RESEARCH AGREEMENT

Not Applicable

REFERENCE TO A SEQUENCE LISTING, A TABLE, OR A COMPUTER PROGRAM LISTING

Not Applicable

BACKGROUND OF THE INVENTION

Garment and jersey manufactures are always looking for new and exciting ways to improve the look and performance of their products. For instance, compression garments have become very popular. These garments are form fitting and use synthetic fabrics that have elastic properties. These fabrics tend to wick away perspiration and tend to help cool athletes when they are hot and warm them if they are cool. However, advertisements and emblems on these garments tend to be flat, subtle and mundane, which limits the revenue from advertisers and excitement for the fans.

Thus there exists a need for method of creating fabrics that are dynamic and flashy.

BRIEF SUMMARY OF INVENTION

A method of creating an image on a fabric that overcomes these and other problems includes the steps of selecting a stretch fabric having a front side and a back side. A front side of the fabric is dyed with a solid color. A back side of the fabric is dyed with a knock out image. The knock out image is visible when the stretch fabric is stretched and is not visible when the stretch fabric is in a relaxed state. In one embodiment, the fabric is part of jersey and when the player stretches the fabric an image becomes visible. In another embodiment, the image expands or seems to glow. This provides a dynamic flashy image that is exciting to advertisers and fans alike.

DETAILED DESCRIPTION OF THE INVENTION

The invention is directed to method of creating and image on a fabric that includes the steps of selecting a stretch fabric having a front side and a back side. A front side of the fabric is dyed with a solid color. A back side of the fabric is dyed with a knock out image. The knock out image is visible when the stretch fabric is stretched and is not visible when the stretch fabric is in a relaxed state. In one embodiment, the fabric is part of jersey and when the player stretches the fabric an image becomes visible. In another embodiment, the image expands or seems to glow. This provides a dynamic flashy image that is exciting to advertisers and fans alike.

Definitions

Neon color means an extremely bright color.

Stretch fabric means a fabric capable of being stretch in at least one direction 150% of original length under force and returning to its original length when the force is removed.

Knock out pattern means a pattern where the image is not printed/dyed/colored, but the area surrounding the image is printed/dyed/colored.

Darker means that a color reflects less light than another color.

Figure 1:
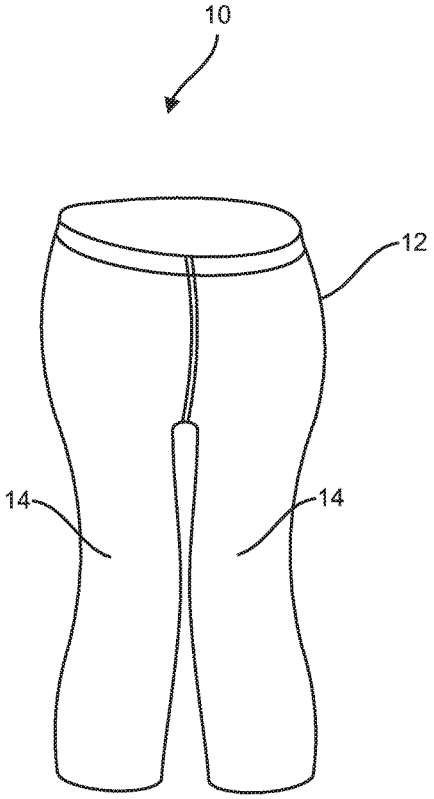
FIG. 1 is a cartoon drawing of a garment in accordance with one embodiment of the invention.
Figure 2:
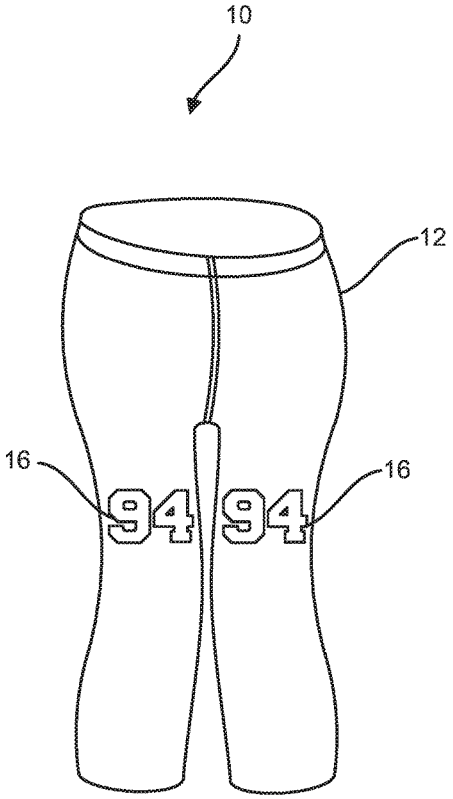
FIG. 2 is a cartoon drawing of a garment in accordance with one embodiment of the invention.

FIG. 1 is a cartoon drawing of a garment 10 in accordance with one embodiment of the invention. In this example the garment is a pair of football pants 12. The pants are either made of stretch fabric or at least the knee portion 14 of the pants 12 are made of stretch fabric with an image created thereon. FIG. 2 is a cartoon drawing of a garment 10 in accordance with one embodiment of the invention. In this figure the fabric in the knee 14 is stretched and the image 16 is now visible. In this case the image is the player's number, but any image can be created. The image is dynamic because it is visible when the fabric is stretched, but not visible when the fabric is in a relaxed state. The size and the brightness of the image varies depending on how much the fabric is stretched, making a flashy image.

Figure 3:
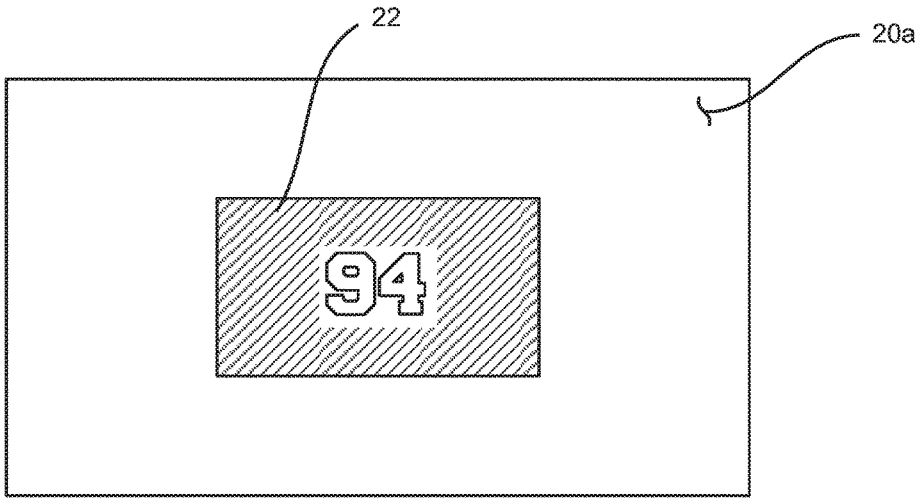
FIG. 3 is a fabric with a first image in accordance with one embodiment of the invention.

FIG. 3 is a fabric 20*a* with a first image in accordance with one embodiment of the invention. The fabric 20*a* is a stretch fabric that may be a two way or a four way stretch fabric. However, the four way stretch fabric is generally preferred for most applications. For best result, the fabric's original color is very bright, such as a neon color although this will also work on white or light colored fabrics. The fabric 20*a* has a first side 20*a* and a second side 20*b*. In one embodiment, the back side 20*a* is dyed with a knock out image 22 although other images than knock out images may be used. Note the number 94 is not dyed. For best results a sublimation dye process is used to make the image. Sublimation dying may be a direct printing process or may be an indirect process using transfer paper as is well understood in the art.

Figure 4:
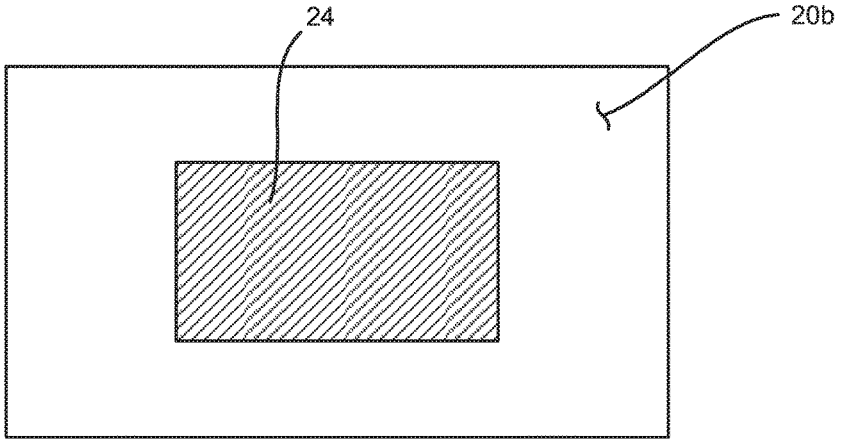
FIG. 4 is a fabric with a second image in accordance with one embodiment of the invention.

FIG. 4 is the fabric 20*b* with a second image 24 in accordance with one embodiment of the invention. The second image is printed on the front side 20*b* of the fabric

20. The dye color is darker than the fabric color and in one embodiment is the same color as the dye used to make the knock out image 22.

In another embodiment, the knock out image 22 is placed on a first fabric 20*a* and the cover 24 is placed on a second fabric 20*b*. The two pieces 20*a*, 20*b* of fabric are held together so the images overlap with the first fabric 20*a* on the outside. When the fabrics are stretched the knock out image 22 is visible. For the best results the second fabric 20*b* is a light colored fabric.

Note in one embodiment, the image 22 may be something other than a knock out image.

Figure 5:
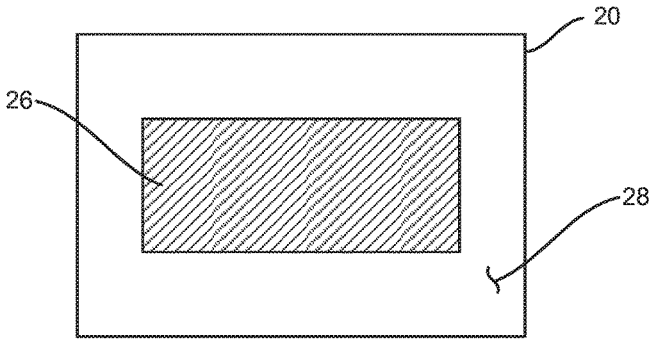
FIG. 5 is a front view of a stretch fabric in a relaxed state in accordance with one embodiment of the invention.
Figure 6:
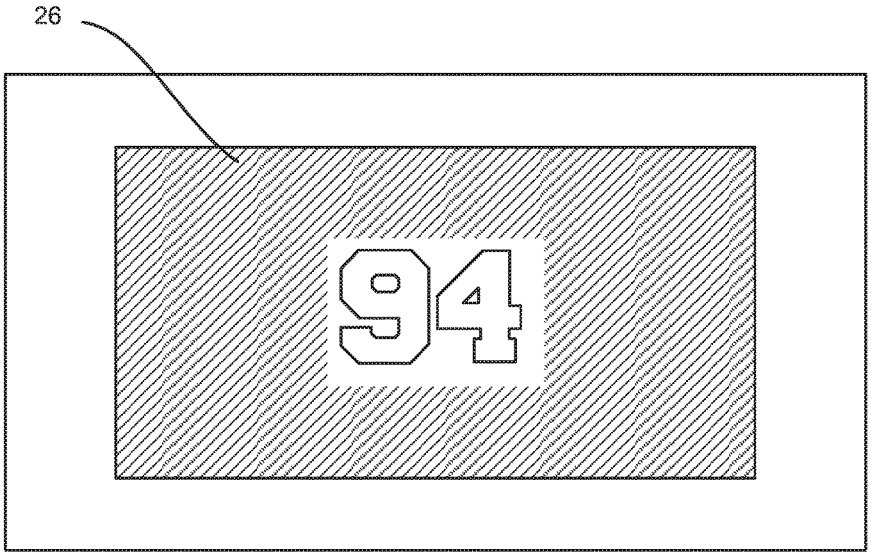
FIG. 6 is a front view of a stretch fabric in a stretched state in accordance with one embodiment of the invention.

FIG. 5 is a front view of a stretch fabric 20 in a relaxed state in accordance with one embodiment of the invention after it has been dyed as explained with respect to FIGS. 3 & 4. The image 26 just looks like a dark square on the fabric 20. Note that the image may be a circle, oval or almost any shape. In one embodiment all of the fabric is dyed so there is no un-dyed portion 28. FIG. 6 is a front view of a stretch fabric in a stretched state in accordance with one embodiment of the invention. Now the image 26 shows the number 94. The number 94 will have the same color (or similar color) as the original fabric.

Figure 7:
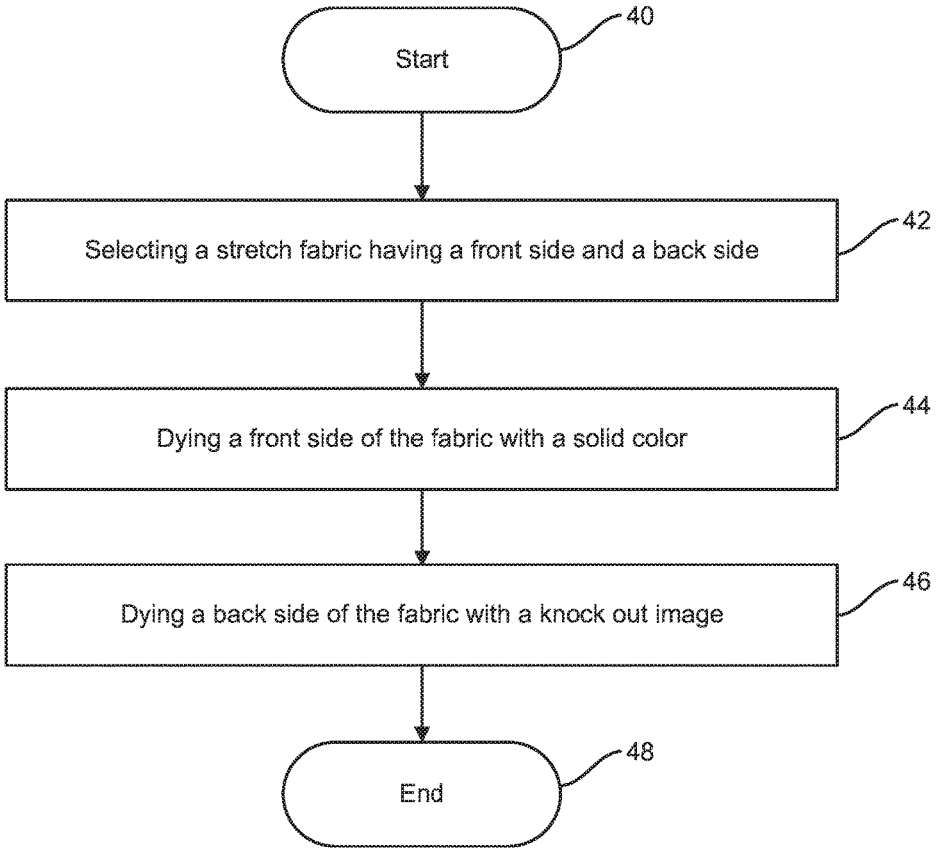
FIG. 7 is a flow chart of the step used in a method of creating an image on a stretch fabric in accordance with one embodiment of the invention.

FIG. 7 is a flow chart of the step used in a method of creating an image on a stretch fabric in accordance with one embodiment of the invention. The process starts, step 40, by selecting a stretch fabric have a front side and a back side at step 42. The front side of the fabric is dyed with a solid color at step 44. At step 46, a back side of the fabric is dyed with a knock out image, which ends the process at step 48. The order of when the images are dyed in not important in this embodiment.

Without being held to any particular theory the invention is believed to work because just the surface fibers of the stretch fabric are dyed. When the fabric is stretched part of the fibers are now exposed that were not dyed. Thus by dying the front and back with a darker color except where the knock out image is results in the only un-dyed fibers are those in the knock out image. Note this effect can also be achieved by first placing the knock out image on the front of the fabric and then dying a filled in image over the top of the knock out image, but it is not the preferred method. If this theory is correct the key points to the invention are just coloring the surface fibers in the relaxed state and coloring them with something that does not inhibit the stretching of the fabric/fibers.

Thus there has been described a method of creating fabrics that which is dynamic and flashy.

While the invention has been described in conjunction with specific embodiments thereof, it is evident that many alterations, modifications, and variations will be apparent to those skilled in the art in light of the foregoing description. Accordingly, it is intended to embrace all such alterations, modifications, and variations in the appended claims.

What is claimed is:

1. A method of creating an image on a fabric, comprising:

selecting a stretch fabric having a front side and a back side, and being composed of a plurality of fibers, the plurality of fibers being able to stretch;

dying a front surface of the plurality of fibers on the front side of the fabric with a solid color, the solid color creating an image on the front side; and dying a first portion of a back surface of the plurality of fibers on the back side of the stretch fabric with the solid color and leaving a second portion of the back surface with a knock out image, the knock out image being un-dyed;

wherein the knock out image is visible from the front side of the stretch fabric when the stretch fabric is stretched because of being undyed;

wherein stretching exposes part of the plurality of fibers that are undyed and make up the knockout image; and wherein the knock out image is not visible when the stretch fabric is in a relaxed state, due to the plurality of fibers being unstretched.

2. The method of claim 1, wherein the step of selecting the stretch fabric includes selecting the stretch fabric to be part of a garment.

3. The method of claim 1, wherein the step of selecting the stretch fabric includes the step of selecting a four way stretch fabric.

4. The method of claim 1, wherein the step of selecting the stretch fabric includes the step of selecting a two-way stretch fabric.

5. The method of claim 1, wherein the step of selecting the stretch fabric includes the step of selecting a neon colored fabric.

6. The method of claim 1, wherein the step of dying the back side of the fabric includes the step of using a sublimation dying process.

7. The method of claim 1, wherein the step of dying the front side of the fabric includes the step of using a sublimation dying process.

8. The method of claim 6, wherein the step of using a sublimation dying process includes the step of using a direct dye sublimation process.

9. The method of claim 7, wherein the step of using a sublimation dying processes includes the step of using a transfer dye sublimation process.

10. The method of claim 1, wherein the step of dying the front side of the fabric includes selecting a dye with a color darker than a fabric color of the fabric.

* * * * *